US008615855B2

(12) United States Patent
Montgomery

(10) Patent No.: US 8,615,855 B2
(45) Date of Patent: Dec. 31, 2013

(54) THEMED CEMETERY

(76) Inventor: David Montgomery, Ladera Ranch, CA (US)

( * ) Notice: Subject to any disclaimer, the term of this patent is extended or adjusted under 35 U.S.C. 154(b) by 524 days.

(21) Appl. No.: 12/606,977

(22) Filed: Oct. 27, 2009

(65) Prior Publication Data

US 2010/0101158 A1 Apr. 29, 2010

Related U.S. Application Data

(60) Provisional application No. 61/108,670, filed on Oct. 27, 2008.

(51) Int. Cl.
*A61G 17/00* (2006.01)
*E01F 9/011* (2006.01)
*E04H 13/00* (2006.01)

(52) U.S. Cl.
USPC ..... 27/1; 52/103

(58) Field of Classification Search
USPC ..... 52/128, 133, 134, 103; 40/124.5; 27/1
See application file for complete search history.

(56) References Cited

U.S. PATENT DOCUMENTS

| | | | | |
|---|---|---|---|---|
| 1,096,758 | A * | 5/1914 | Rogers | 52/132 |
| 4,688,359 | A * | 8/1987 | See | 52/134 |
| 4,977,652 | A * | 12/1990 | Graham | 27/1 |
| 5,408,786 | A * | 4/1995 | Konno | 52/128 |
| 6,052,954 | A * | 4/2000 | Dudek et al. | 52/128 |
| 6,261,028 | B1 * | 7/2001 | Volpe et al. | 405/210 |
| 6,662,416 | B1 * | 12/2003 | Huggins | 27/1 |
| 6,681,534 | B2 * | 1/2004 | David et al. | 52/134 |
| 6,799,399 | B2 * | 10/2004 | Dudek et al. | 52/128 |
| 6,854,165 | B1 * | 2/2005 | Parker | 27/1 |
| 7,036,196 | B2 * | 5/2006 | Salatin et al. | 27/27 |
| 7,089,495 | B2 * | 8/2006 | Barrows | 715/717 |
| 7,165,297 | B2 * | 1/2007 | Poole et al. | 27/1 |
| 7,421,765 | B1 * | 9/2008 | Kaiser | 27/1 |
| 7,900,327 | B2 * | 3/2011 | Elhaj | 27/35 |
| 8,196,274 | B2 * | 6/2012 | Heckenbach | 27/1 |
| 2001/0036354 | A1 * | 11/2001 | Majors | 386/46 |
| 2002/0133360 | A1 * | 9/2002 | Hill et al. | 705/1 |
| 2003/0145533 | A1 * | 8/2003 | Dudek et al. | 52/128 |
| 2006/0053604 | A1 * | 3/2006 | Brine | 27/1 |
| 2010/0075767 | A1 * | 3/2010 | Correll | 472/136 |

(Continued)

OTHER PUBLICATIONS

"Beyond the Vines", Sun Times Article, Kara Spak, Jul. 13, 2008, (http://web.archive.org/web/20080915133312/http://beyondthevines.net/SunTimesarticle.aspx—Way Back Machine Date—Sep. 15, 2008).*

(Continued)

*Primary Examiner* — Ryan Kwiecinski
(74) *Attorney, Agent, or Firm* — Rutan & Tucker LLP; Hani Z. Sayed

(57) ABSTRACT

An improved cemetery experience whereby the cemetery and accompanying facilities may celebrate and demonstrate the passion and hobbies of the deceased individual. The contemplated themed cemetery may be a stand-alone cemetery that celebrates a common passion of a plurality of individuals, yet still maintains the traditional burial and memorialization process. The themed cemetery may take a specific event, or commonly understood and loved location and memorialize that location in the theme of a cemetery where those with that common interest and enjoyment of the commonly understood location may desire to be buried. The cemetery would closely resemble both visually, and physically a replica of the theme being celebrated and may provide space for the deceased while still providing adequate income and revenue in the way of advertising for the operator.

20 Claims, 10 Drawing Sheets

(56) References Cited

U.S. PATENT DOCUMENTS

| | | | | |
|---|---|---|---|---|
| 2010/0101158 | A1* | 4/2010 | Montgomery | 52/103 |
| 2010/0313395 | A1* | 12/2010 | Heckenbach | 27/1 |
| 2011/0126480 | A1* | 6/2011 | Tsao | 52/133 |
| 2011/0161254 | A1* | 6/2011 | Van Den Bogart | 705/500 |
| 2012/0227227 | A1* | 9/2012 | Heckenbach | 27/1 |

OTHER PUBLICATIONS

"Beyond the Vines", Home, (http://web.archive.org/web/20080915030157/http://beyondthevines.net/default.aspx—Way Back Date—Sep. 15, 2008).*

"Beyond the Vines", Media Coverage, Don Babwin, (http://web.archive.org/web/20080915133342/http://beyondthevines.net/mediacoverage.aspx—Way Back Date—Sep. 15, 2008).*

"Beyond the Vines", Packages, (http://web.archive.org/web/20080915133254/http://beyondthevines.net/Packages.aspx—Way Back Date—Sep. 15, 2008).*

"Beyond the Vines", Ground Breaking News, (http://web.archive.org/web/20080915133249/http://beyondthevines.net/GroundBreakingday.aspx—Way Back Machine Date—Sep. 15, 2008).*

"Beyond the Ivy", Fans Forever Inc. "http://fansforeverinc.blogspot.com/2008/07/fans-forever-inc-announces-first.html"—Wednesday Jul. 9, 2008.*

"For Die-Hard Fans, a Cubs-Themed Cemetery", NPR, Scott Simon, Audio/article, "http://www.npr.org/templates/story/story.php?storyId=92705098", Jul. 19, 2008.*

"Philadelphia Sports Cemetery", The Philadelphia Daily News, Rich Hofman, "http://www.philly.com/philly/blogs/hofmann/The_Philadelphia_Sports_Cemetery.html", Sep. 10, 2008.*

* cited by examiner

THEMED CEMETERY

CROSS REFERENCE TO RELATED APPLICATIONS

This application claims priority to the earlier filed U.S. Provisional Patent Application No. 61/108,670 filed on Oct. 27, 2008, which is incorporated herein by reference in its entirety.

FIELD OF THE INVENTION

The field of the invention is for cemeteries. More specifically, the field of invention is for a cemetery having a themed and unique configuration relating to an event, apparatus and the like.

BACKGROUND

Cemeteries and different burial places have been contemplated from the beginning of time. The human race has always desired the best ways to respect and bury their dead. The type of burial has changed over the centuries to include burning, burying, sending out to sea, building elaborate burial structures and the like.

The two most common types of burial methods today are cremation and casket burial. In more recent times, cremation has become more prevalent and is a little less expensive as it does not require acquiring a plot, or tombstone/gravestone. However, what is actually done with the cremation remains is often up to the families or the deceased. Many wish their ashes to be spread or placed at certain locations and others are stored by loved ones. The second traditional method of burial includes the use of a casket, plot and gravestone/mausoleum. The dead are prepared for burial, placed in a casket, and lowered into the ground. A gravestone or mausoleum is placed on top of the burial site to mark where the deceased is located. Typically, prior art cemeteries are parks with trees, grass and other park-like structures. Some prior art cemeteries are located on church grounds or other holy sites. Cremation remains are also sometimes found at these similar locations.

However, no significant developments have been made in the cemetery industry for some time. One way of denoting the interests and hobbies of the deceased individual is to carve the information directly onto the deceased headstone or gravestone. The information provided may give some idea of the individual's personal life, hobbies or other information that may immediately denote some characteristic or personal trait of the individual. Outside the markings of a headstone or gravestone, it is often very difficult to identify characteristics about the individual that may have identified their personal traits, interests or hobbies.

Therefore, a need exists for a new and unique cemetery theme that may allow the deceased some options when considering where and how to be buried. Additionally, a need exists for an improved cemetery which may provide greater deference and options to individuals that may be dictated by personal interests and hobbies while still giving the options for the type of burial ceremony, including cremation and/or traditional casket burial. Moreover, a need exists for an improved themed cemetery that may celebrate the common passion in the memorialization process, yet still give diverse burial options.

SUMMARY OF THE INVENTION

The present invention provides an improved cemetery experience whereby the cemetery and accompanying facilities may celebrate and demonstrate the passion and hobbies of the deceased individual. The contemplated themed cemetery may be a stand-alone cemetery that celebrates a common passion of a plurality of individuals, yet still maintains the traditional burial and memorialization process. The themed cemetery may take a specific event, or commonly understood and loved location and memorialize that location in the theme of a cemetery where those with that common interest and enjoyment of the commonly understood location may desire to be buried. The cemetery would closely resemble both visually and physically, a replica of the theme being celebrated and may provide space for the deceased while still providing adequate income and revenue in the way of advertising for the operator.

Among the many different possibilities contemplated, a themed cemetery may be provided for burial of the deceased.

To this end, in an exemplary embodiment of the present invention, a themed cemetery, the cemetery comprising: a portion of property replicating at least a venue both physically and visually; a plurality of plots located within the famous venue; said plots capable of holding traditional caskets and cremated remains; and at least a portion of the famous structure having advertising space thereon.

In an exemplary embodiment, the themed cemetery venue is a baseball stadium.

In an exemplary embodiment, the themed cemetery venue is a golf course.

In an exemplary embodiment, the themed cemetery venue is a football stadium.

In an exemplary embodiment, the themed cemetery venue is an automobile racetrack.

In an exemplary embodiment, the themed cemetery venue is a casino, building, racetrack, and/or any other notable structure.

In an exemplary embodiment, the themed cemetery plots are capable of holding human remains whereby the plots may have different revenue value depending on location within the famous venue.

In an exemplary embodiment, the themed cemetery advertising space is provided on the outside walls of the famous venue.

In an exemplary embodiment, the themed cemetery advertising and promotional space is provided within the venue to coincide with the advertising and promotional space provided at the corresponding real world facility for which the cemetery is modeled after.

In an exemplary embodiment, the themed cemetery advertising space is provided in the same locations where advertising is found in a real life famous venue.

In an exemplary embodiment, the themed cemetery further comprises: unique burial headstones having personal preferences that relate to the famous venue.

In yet another exemplary embodiment, a method for creating a themed cemetery is provided. The method comprising the steps of: providing a property which replicates at least a landmark venue both physically and visually; providing a plurality of plots located at different locations within the landmark venue; said plots located at different locations whereby said different locations being capable of holding either traditional caskets or cremated remains; and at least a portion of the famous structure having advertising space thereon.

In an exemplary embodiment, the method further comprises the step of: providing areas within the landmark venue capable of holding human remains whereby the plots have assigned values depending on the location within the landmark venue.

In an exemplary embodiment, the method further comprises the step of: allowing deceased individuals to be buried in a familiar location to social activities that the deceased member was involved in during their life, which is associated with the landmark venue.

In an exemplary embodiment, the method further comprises the step of: providing a seating area for visitors coming to the landmark venue whereby space is provided in the seating area for placement of deceased individuals' remains.

In an exemplary embodiment, the method further comprises the step of: said landmark venue being any of: a baseball stadium, a golf course, a basketball, hockey, football stadium, a car racing park, a traditional park, a casino, building, racetrack, famous landmark, structure or building.

In an exemplary embodiment, the method further comprises the step of: providing preferred locations within the landmark venue whereby the preferred locations provide increased revenue for burial at those locations.

In an exemplary embodiment, the method further comprises the step of: providing monuments, articles and memorabilia which are incorporated into the landmark venue to simulate and conjure up memories of the real world facility for which the themed cemetery is modeled thereafter.

In an exemplary embodiment, the method further comprises the step of: providing unique burial headstones and plots which have personal preferences and memorabilia that relate to the landmark venue.

In an exemplary embodiment, the method further comprises the step of: providing advertising and promotional space within the venue to coincide with the advertising and promotional space provided at the corresponding real world facility for which the cemetery is modeled after.

Additionally, in an exemplary embodiment, a themed cemetery may be provided whereby the cemetery may deliver a visual and a substantially similar replica of the theme being celebrated.

In yet another exemplary embodiment, it is contemplated that the themed cemetery may take the form of a scaled replica of a famous golf course.

In another exemplary embodiment, it is contemplated that the themed cemetery may take the form of a scaled replica of a football stadium such as Soldier Field, Lambeau Field, or Qualcomm Stadium.

A further exemplary embodiment contemplates that the themed cemetery may be formed to replicate a baseball stadium such as Wrigley Field, Fenway Park or Yankee Stadium.

In yet another exemplary embodiment, the themed cemetery may be adapted to replicate a driving forum such as the Daytona 500 and/or Talladega.

Additionally, in an exemplary embodiment, the themed cemetery may be adapted to replicate a famous casino, a famous building or any other structure, theme or hobby that may have been of interest to a plurality of deceased individuals.

In yet another exemplary embodiment of the present invention, the themed cemetery may celebrate a common passion and/or theme in every aspect of the traditional burial and memorialization process.

Still another exemplary embodiment of the present invention is to provide a themed cemetery whereby the theme is celebrated through the unique property design.

Yet another exemplary embodiment of the present invention is to provide a themed cemetery whereby the cemetery is specifically customized as a funeral and/or burial service with diverse burial options.

Still another exemplary embodiment is to provide a themed cemetery whereby the operators and creators of the cemetery would make every effort to deliver a visual and physical replica of the original venue to be celebrated, whether it may be a stadium, building or golf course.

Another exemplary embodiment of the invention is to provide a themed cemetery whereby the theme may be a NASCAR race track.

In yet another exemplary embodiment, a themed cemetery may be provided whereby the themed cemetery may utilize and capture the excitement of being at the actual themed event which the cemetery is designed after.

A further exemplary embodiment is to provide a themed cemetery whereby the physical size of the cemetery would be substantial in an effort to capture the feel of the true stadium, building, or venue.

Another exemplary embodiment is to provide a themed cemetery whereby the cemetery may have various portions thereof which may be of higher value to certain individuals, including bleachers which an individual may have spent a lot of time in, or premium boxes which may have been a favorite for the deceased. Similarly, an individual may wish to be buried in an infield portion of a stadium, or the pit area of a NASCAR themed cemetery, which may be chosen by the individual depending on their tastes.

A further exemplary embodiment is to provide a themed cemetery whereby the themed concept may be followed through in a design to include things like stadium seating that may be designed as community niches, which from a quantity standpoint may be most prevalent.

Still another exemplary embodiment is to provide a themed cemetery whereby the themed concept may be followed through in a design to include aspects such as viewing towers and private box niches, pit areas, winner's circles for car and horse racing venues, in-fields and end zones in stadium venues, and even outside walls that may be utilized to store the cremated remains of an individual.

Yet another exemplary embodiment is to provide a themed cemetery whereby the themed cemetery may also include a revenue stream for the operators by allowing advertising which have become common in most venues. The operator may sell advertising space on the outside walls, the pit areas, or box areas as are commonly found in most sporting venues. Thereby the operator of the cemetery may generate multiple revenue streams and may change the advertising space in the same manner as most venues change advertising space and use depending on time and other factors.

In another exemplary embodiment, the themed cemetery may be provide whereby the themed cemetery may be constructed to constitute any of a plurality of sporting or leisure events including baseball, basketball courts, hockey rinks, horse racing grounds, children's playgrounds, favorite restaurants, specific city buildings, country buildings, miniaturized landmarks, and the like.

In still another exemplary embodiment, unique tombstones, headstones and gravestones may be utilized to demonstrate a particular individual's interest in that venue. For example, an individual may have a personal connection to a certain individual car, green (for golf) or player, whereby the individual may utilize unique headstones that display their preferences within the themed cemetery.

Various objects, features, aspects and advantages of the present invention will become more apparent from the following detailed description of preferred embodiments of the invention, along with the accompanying drawings in which like numerals represent like components.

DETAILED DESCRIPTION OF THE INVENTION

The following description of a preferred embodiment(s) is merely exemplary in nature and is in no way intended to limit the invention, its application, or uses. For ease of description, only one exemplary embodiment is herein described in detail. However, it should be understood that a person of ordinary skill in the art would contemplate that any of a plurality of embodiments may utilize the same themed cemetery construction for many different themes including stadiums, landmarks, buildings, parks, and the like. It should be understood that the use of a car racing stadium is utilized only for illustration purposes only and is in no way limited to only race car stadiums.

Figure 1:
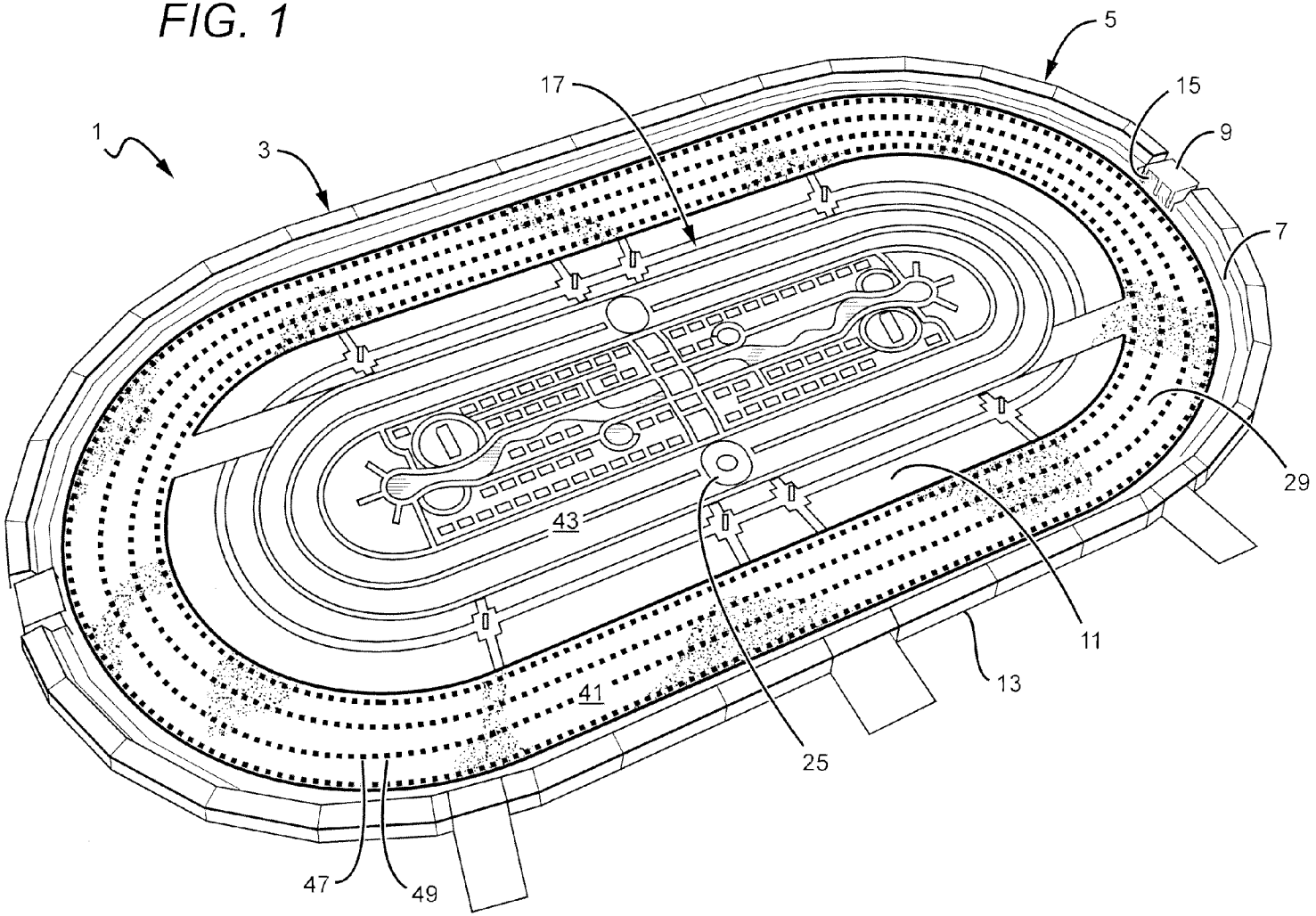
FIG. 1 illustrates a perspective diagram of the invention in an exemplary embodiment of the present invention.

FIG. 1 illustrates an overall perspective view of a themed cemetery 1. The themed cemetery 1 may take any of a plurality of shapes and sizes, depending on the desires and accommodations necessary for those wishing to be interned at the location. The themed cemetery 1 may take the form of a car racing facility 3 as illustrated in FIG. 1, but may also take the form of any preferred landmarks, including sports stadiums, arenas, famous landmarks such as parks, buildings, structures, vehicles, trains, planes and the like. For illustrative purposes, FIG. 1 illustrates a themed cemetery 1 in the form of a racing car facility 3 such as those found in famous car racing tracks like Daytona raceway, (not shown) California raceway (not shown) and/or the Indianapolis raceway (not shown).

As illustrated in FIG. 1, the themed cemetery 1 in the form of a racing car facility 3 may have a plurality of sections included therein. For example, the racing car facility 3 may have many of the same features commonly found on the actual racing car facility 3 for which it is modeled. The themed cemetery 1 may include grandstands 5, commonly found in most real world racing car facilities. The grandstands 5 may include a plurality of areas including at least a seating area 7, media box areas 9, and grandstand burial areas 11. It is contemplated that the grandstand 5 take the same form and shape as the real world racing car facilities and be approximately the same relational size to the real facilities. As mentioned earlier, the grandstands 5 of the themed cemetery 1 may have a seating area 7 which may be used by those individuals that come to visit those interned there. The seating area 7 of the grandstands 5 may also provide an area which may be suitably familiar to the individuals that may be visiting loved ones buried in the themed cemetery 1. For example, friends that may have attended baseball games together and held season passes or attended race car events together and sat in the same location for years, may desire to sit in those same locations in the grandstands 5 when visiting the friends and/or relatives that may be buried at the themed cemetery 1. A greater sense of familiarity may be provided with the seating area 7 of the grandstand 5. Moreover, providing adequate seating area 7 may also allow for the accommodation of more people in the themed cemetery 1 and may also relax some of the anxiety related to visiting individuals at a cemetery.

Additionally, as illustrated in FIG. 1, the themed cemetery 1 may also have a grandstand area 5 which may include media boxes 9 or luxury boxes. These media/luxury boxes 9 may be located in similar locations as those in the real world facilities. Many individuals have luxury boxes and a great deal of their social life while they were alive revolved around these luxury boxes 9. These media/luxury boxes 9 may be utilized as either visitor areas or, in the alternative, may be utilized as burial areas for those wishing to be buried in the areas that many spent so much time in. However, as these media/luxury boxes 9 in real life cost significantly more than regular seating areas 7, similarly, the media/luxury boxes 9 may cost more to be buried therein which may increase the exclusivity and profitability to the owner of the themed cemetery 1 facility. The luxury boxes 9 may encompass the entirety of the outside edge 13 of the themed cemetery 1 and may have the added advantage of looking out away from the themed cemetery 1 to property located adjacent (not shown). These luxury boxes 9 may include similar characteristics as those found in the real world facilities including glass 15 which looks towards the infield area 17, the grandstand seating area 7 and even into the winning circle 25, and the track 29 itself.

Included in the grandstands 5 may be a grandstand burial area 11. As enumerated above, many individuals may have spent much of their time at a particular sporting event, such as season tickets for baseball games where the season ticket holder held the same seats for many years. The themed cemetery 1 may provide the individual with the ability to be buried or interned in much the same location or seating area where that individual may have spent so much of their leisure time. Additionally, visitors that knew the individual well, would know that the individual had been buried in the grandstand burial area 11 at a location that was close or at the location where that individual spent much of their leisure time. Many visitors may have at one point or the other, gone to a sporting event with the person interned or buried there and may have fond memories of their time with that individual. The grandstand burial area 11 may also provide nostalgic and/or fond memories for the individuals that visit the deceased, creating a positive atmosphere as opposed to the deserted, and desolate prior art cemetery grounds that provide the atmosphere that would provoke the fond and happy memories, thereby creating a positive cemetery visitor experience.

FIG. 1 also illustrates the track area 29 of the themed cemetery 1 car racing facility 3. The track area 29 could be akin to the baseball field, football field, etc. of another type of facility and is utilized for illustrative purposes only. The track area 29 may have been the focus of the deceased individuals' attention when they were participating or viewing the event. The individual may have some fondness for being buried in the place for which they focused so much of their attention. From the facility owner's standpoint, the track area 29 or the field area in the case of a baseball field, or football field may comprise the majority of the area of the facility and may be the least expensive portion of the themed cemetery 1 to buy. Moreover, because the track area 29 may comprise a large portion of the surface area of the themed cemetery 1, the facility owners may utilize the space to promote aesthetic features of the cemetery 1 including different vegetation/plants 31, along with statues 81, benches 37 (see FIG. 2) and the like. The track area 29 may allow for a park-like atmosphere which includes plants 31, traditional seating areas 37 and walkways 39 which may allow visitors to walk around the track area 29 to view other parts of the themed cemetery 1, sit in the grandstands 5 and to find the appropriate loved family or friend that may be interned or buried at a particular location within the track area 29.

Figure 2:
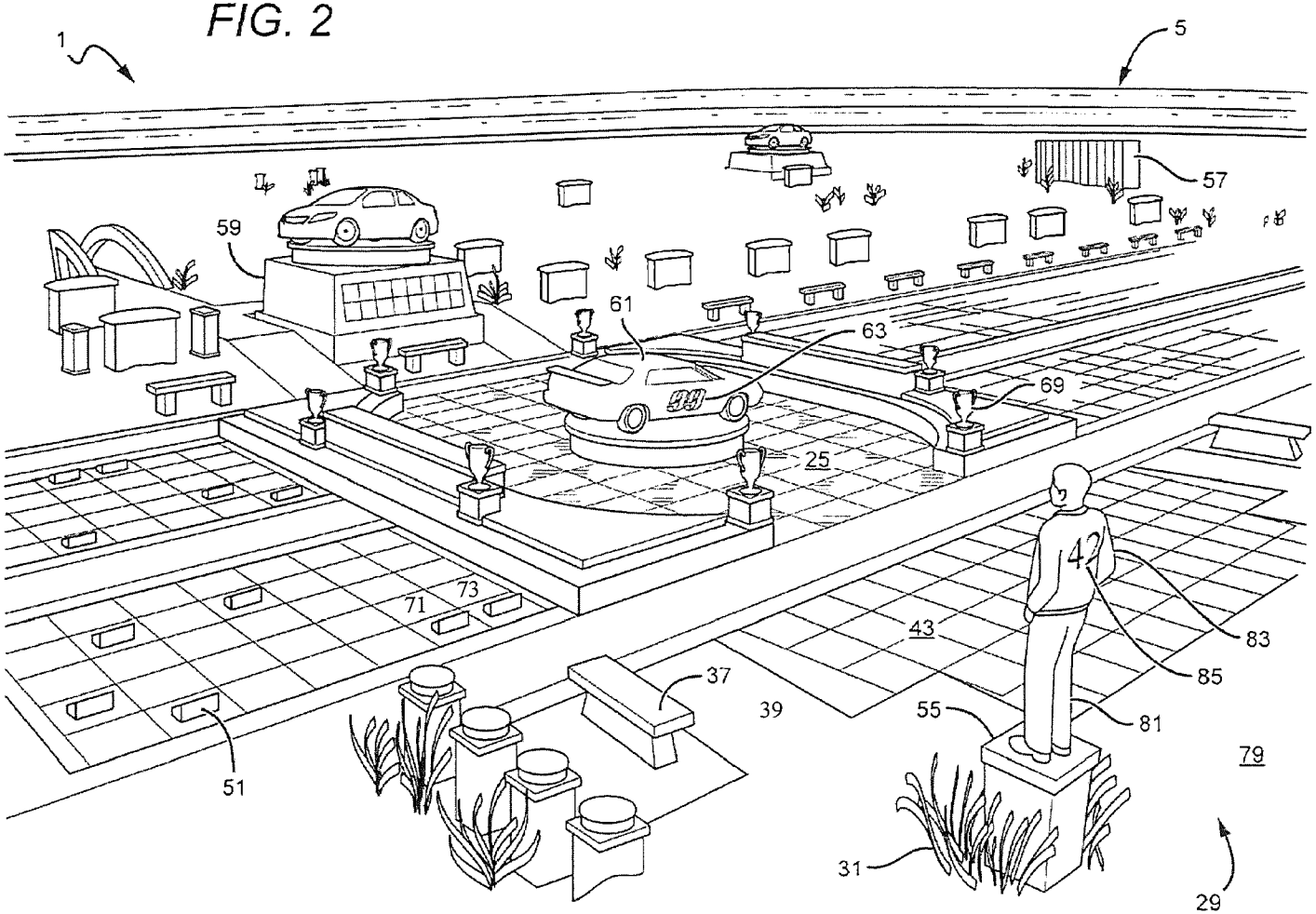
FIG. 2 illustrates the entrance area and grandstand area of the invention in an exemplary embodiment of the present invention.

The track area 29 may even be divided into a first area 41 and a second area 43. The first area 41 may comprise more uniform tombstones 47 that lie at ground level and may complete the aesthetic appearance of a track area 29. Moreover because of their proximity to other tombstones 49, the first area 41 may be marketed as a cheaper area to purchase than other areas of the themed cemetery 1. The second area 43 of the track area 29 may be marketed by the facility owners as a more expensive, larger plot area of the themed cemetery 1. As illustrated in FIG. 2, more ornate tombstones 51 may be located in this second area 43 than those present in the first area 41 of the track area 29. The tombstones 51 may include larger headstones 55, mausoleums 57 and/or more decorative and specific memorials 59. These specific memorials 59 may include figures such as racing cars 61, favorite players/drivers, favorite number designators 63 and many other optional indicia that may show the deceased's preferred and/or love for that specific pastime. FIG. 2 further illustrates the themed cemetery 1 and the continuation of the theme throughout the entire facility, which in the case of the race car facility 3, may include the general presence of racing flags, such as winner's flags, caution flags, and the like that may be incorporated both figuratively into the ground coverings, and other memorial areas and may even include things like trophies 69 which may be placed ornamentally around the entirety of the race car facility 3 themed cemetery 1. Additionally, it is contemplated that the second area 43 may have specific memorials 59 and larger headstones 55, which would likely necessitate larger spaces between a first plot 71 and a second plot 73. Thereby walkways 39 may be incorporated between a first plot 71 and a second plot 73 and vegetation 31 may be incorporated into the spaces therebetween.

FIG. 2 further illustrates the winner's circle area 25 of the themed cemetery 1. The winner's circle area 25 may be set up similarly to the winner's circle of the real world facility. Moreover, the winner's circle area 25 may be marked with ornate decorations such as vegetation 31 and trophies 69 which may mark it as such. Additionally, it is contemplated that the winner's circle may be utilized as a burial place for those wishing to be buried in this specific area whereby the facility owner may choose to charge a premium for burial at that specific location or may use the winner's circle as a visitor's area only with seating areas and the like set up. The winner's circle 25 may be at a focal point to the entire themed cemetery 1, whereby the grandstands 5 and the track area 29 all encircle the winner's circle 25 which may increase the value and location of the burial spots close to the winner's circle 25. Individuals may wish to be buried near that area as many people will desire to visit this area because of its unique ornamentation including plaques and potentially other memorabilia from actual races/sporting events.

Also illustrated in FIG. 2 is the outside edge 79 of the second area 43 of the track area 29. As can be seen, larger headstones 55 may be located in this area that may be adjacent to the winner's circle 25. Moreover, statues 81 may also be placed in this area. In an exemplary embodiment, a statute 81 representing the likeness of a deceased individual may be displaced whereby the individual statue 81 may be wearing their favorite jacket/article 83 of clothing having the indicia of the sporting event or the racing number 85 of their favorite driver thereon. The statue may be displayed to show the deceased individual's love and enthusiasm for a particular sport, event or particular individual, driver or the like, yet still have the personalized touch of bearing the likeness of the deceased individual. Again, the use of the deceased individuals' pastimes may bring joy and fond memories to those visitors that are visiting the themed cemetery 1. The atmosphere may also play a part in encouraging the fond memories of visitors that come into the themed cemetery 1 such that they may re-live some of the experiences that they may have had with their departed loved ones.

Figure 3:
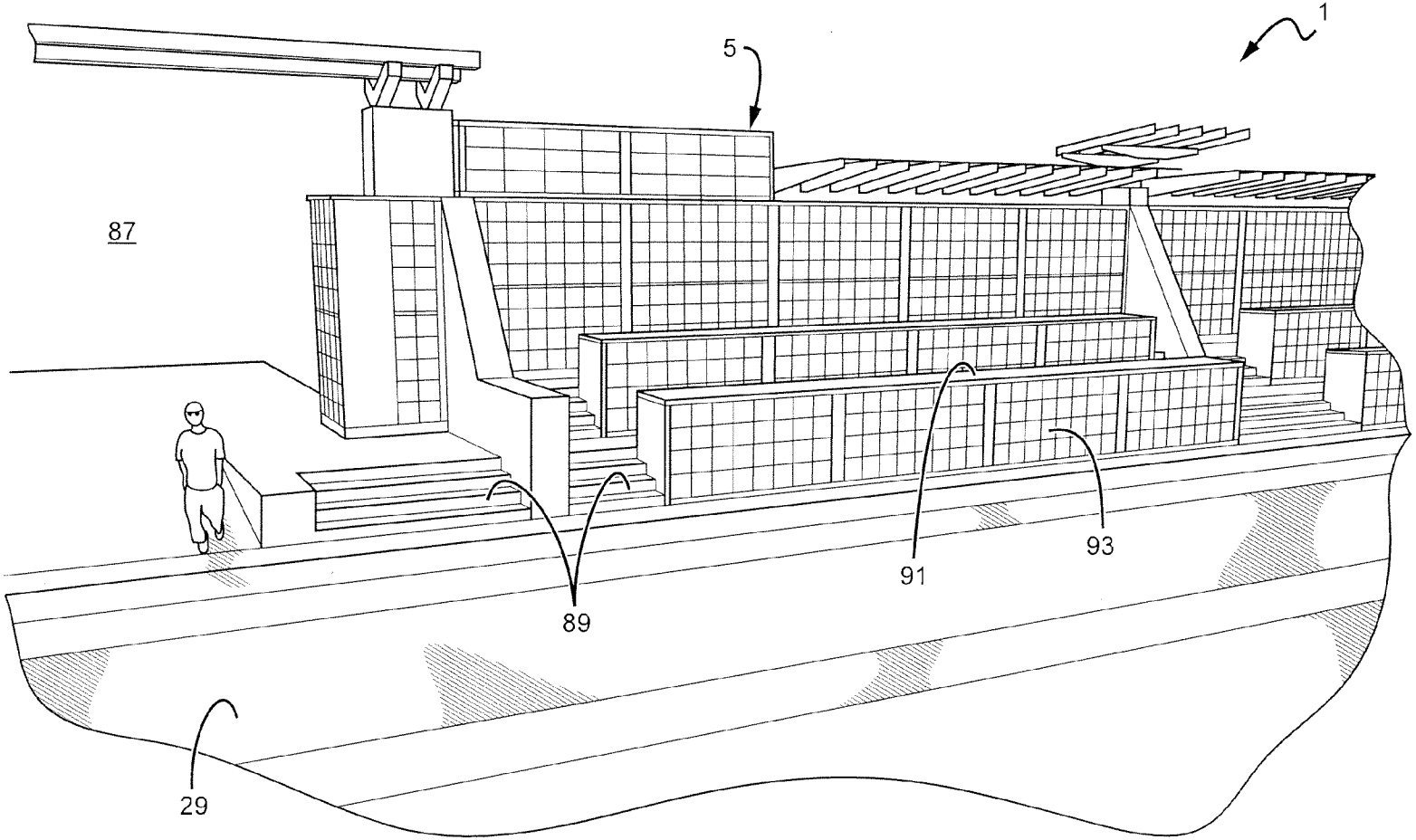
FIG. 3 illustrates a winning circle area of the present invention in an exemplary embodiment.

FIG. 3 further illustrates the grandstands area 5 and the entrance area 87 of the themed cemetery 1. As can be appreciated, the entrance area 87 may lead directly onto the track area 29 and into the grandstand area 5 as would be normally found in a real world facility. Facility owners may also lease the space in the entrance area, or the outside surface of the themed cemetery 1 to potential sponsors and/or advertisers that may wish to advertise and sponsor the facility. This may allow for increased revenue in the themed cemetery 1 and may also lead to the credibility of the facility as many of the real world facilities have similar sponsorships and advertising appearances throughout the entire facility. For example, if a stadium has advertisements placed along the outfield wall, the themed cemetery 1 may lease the space to potential sponsors or businesses that wish to lease the space which would make the themed cemetery 1 look similar to the real world stadium advertisements that people have come accustomed to seeing in the real world facility.

FIG. 3 also illustrates the grandstand area 5 with stairs 89 leading to the grandstands area 5 and stairs 89 leading to the track area 29. The grandstands area 5 may have a plurality of walls 91 which may separate the grandstand areas 5 from the track area 29. The walls 91 may also be set up to accept urns holding the cremated remains of the deceased. Each section of the wall 91 may have plaques 93 located thereon which may identify the final resting place of the individuals interned within that area. It should be understood that the walls 91 may be of sufficient thickness to allow for a plurality of cremated remains to be placed within them, along with the plaques 93 which identify the individual's identity. Also included in the grandstand area 5 as illustrated in FIG. 1 may be a seating area for visitors to come and spend time at the themed cemetery 1 when visiting loved ones.

Figure 4:
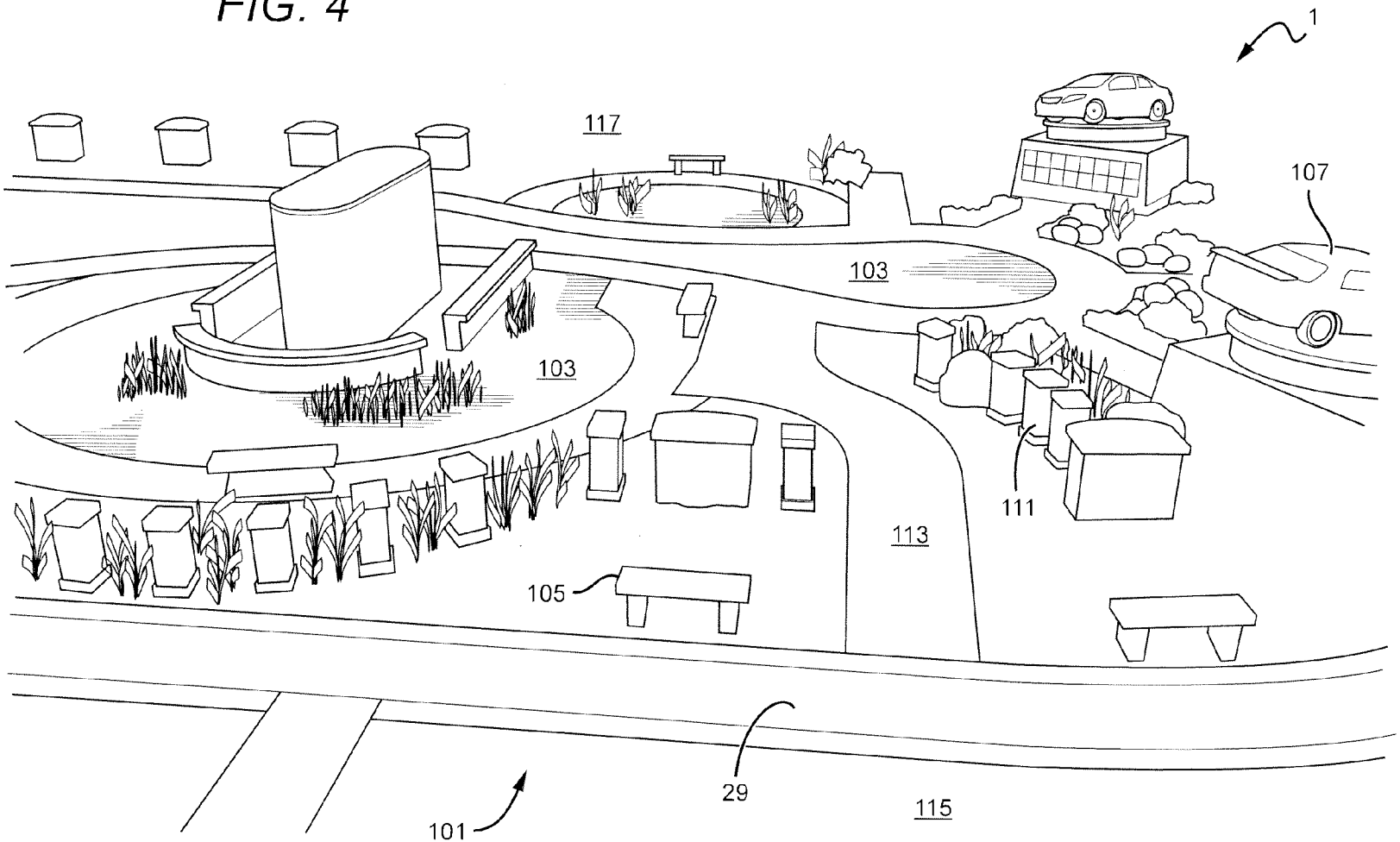
FIG. 4 illustrates the inner green area of the present invention in an exemplary embodiment.

FIG. 4 illustrates the inner field area 101 of the themed cemetery 1. The inner field area 101 may continue the theme of the facility. In this exemplary embodiment, the inner field area 101 of a race car facility may comprise mechanic pits and other holding areas. In this particular embodiment, it may be more desirable to have an inner field area 101 which may be more park like with ponds 103, seating areas 105 and other ornamental features 107 which are still consistent with the overall themed cemetery 1 which may include pedestals 111 having cars, trophies and other activities associated with the theme. Additionally, walkways 113 may be provided to allow walking from one side 115 of the track area 29 to a second side 117 of the track area 29. Other ornamental features and characteristics may be provided to enhance the theme of the cemetery while not detracting from the aesthetic pleasure of the surrounding areas.

Figure 5:
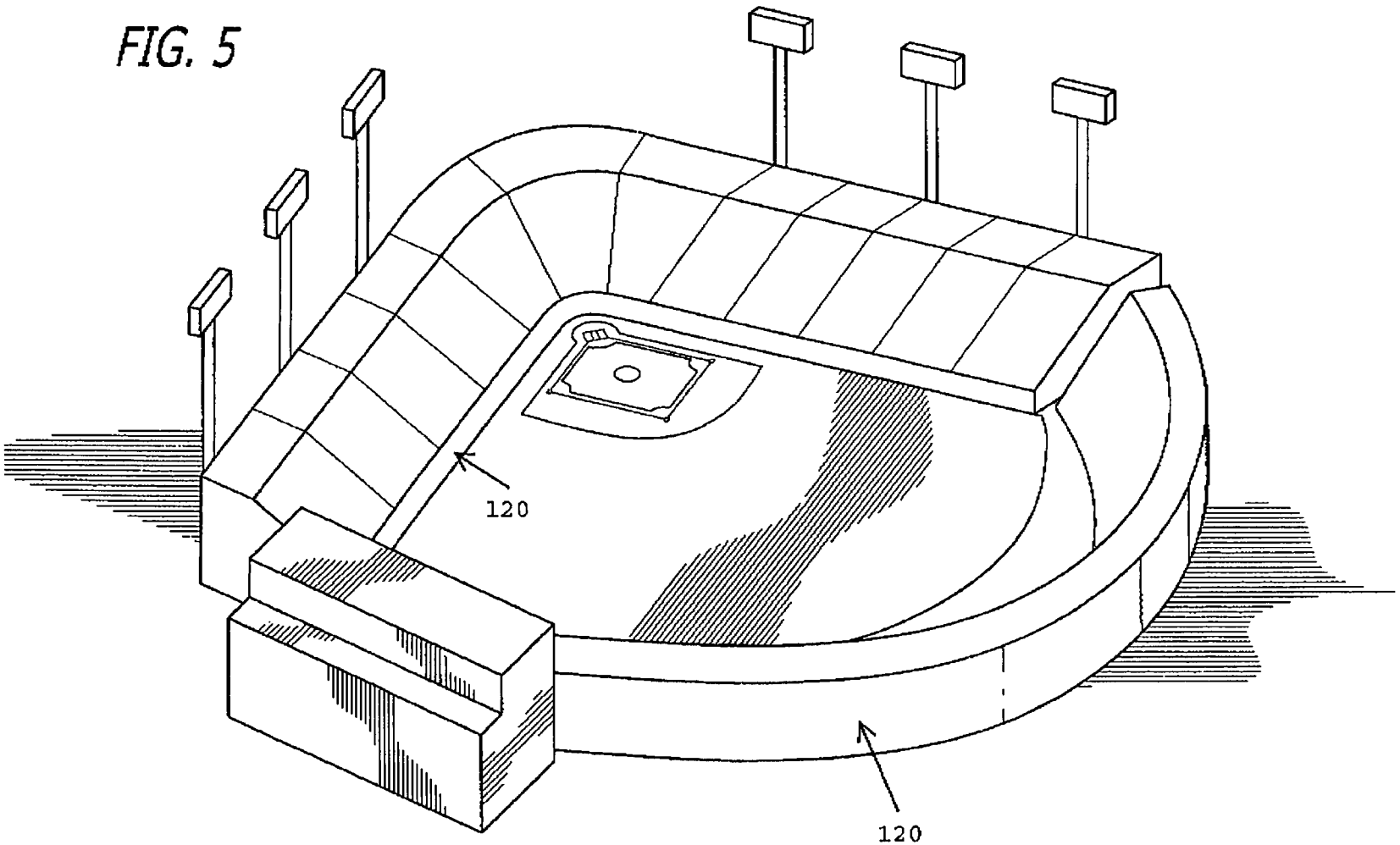
FIG. 5 illustrates a perspective diagram of the invention in an exemplary embodiment of the present invention.
Figure 6:
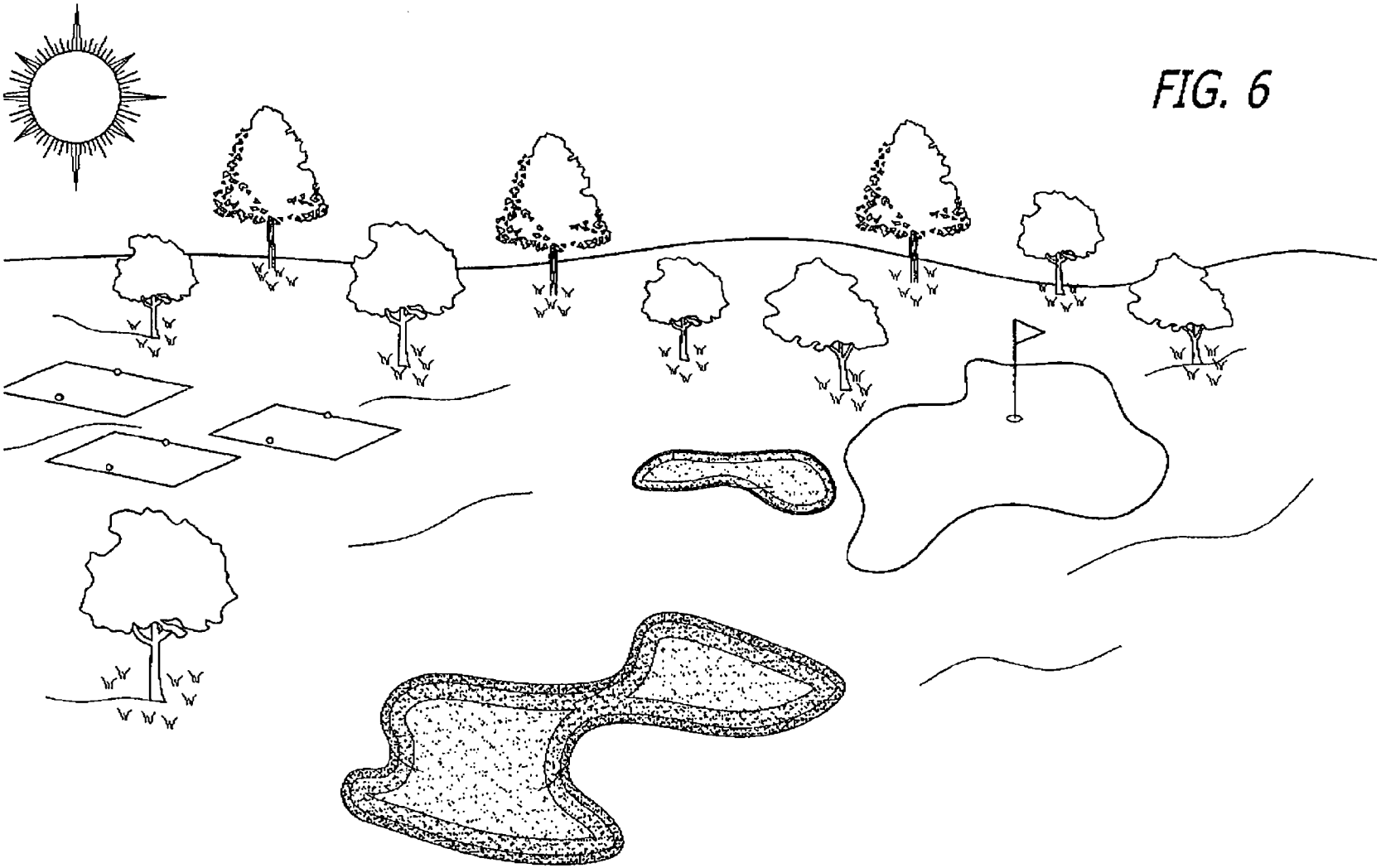
FIG. 6 illustrates a perspective diagram of the invention in an exemplary embodiment of the present invention.
Figure 7:
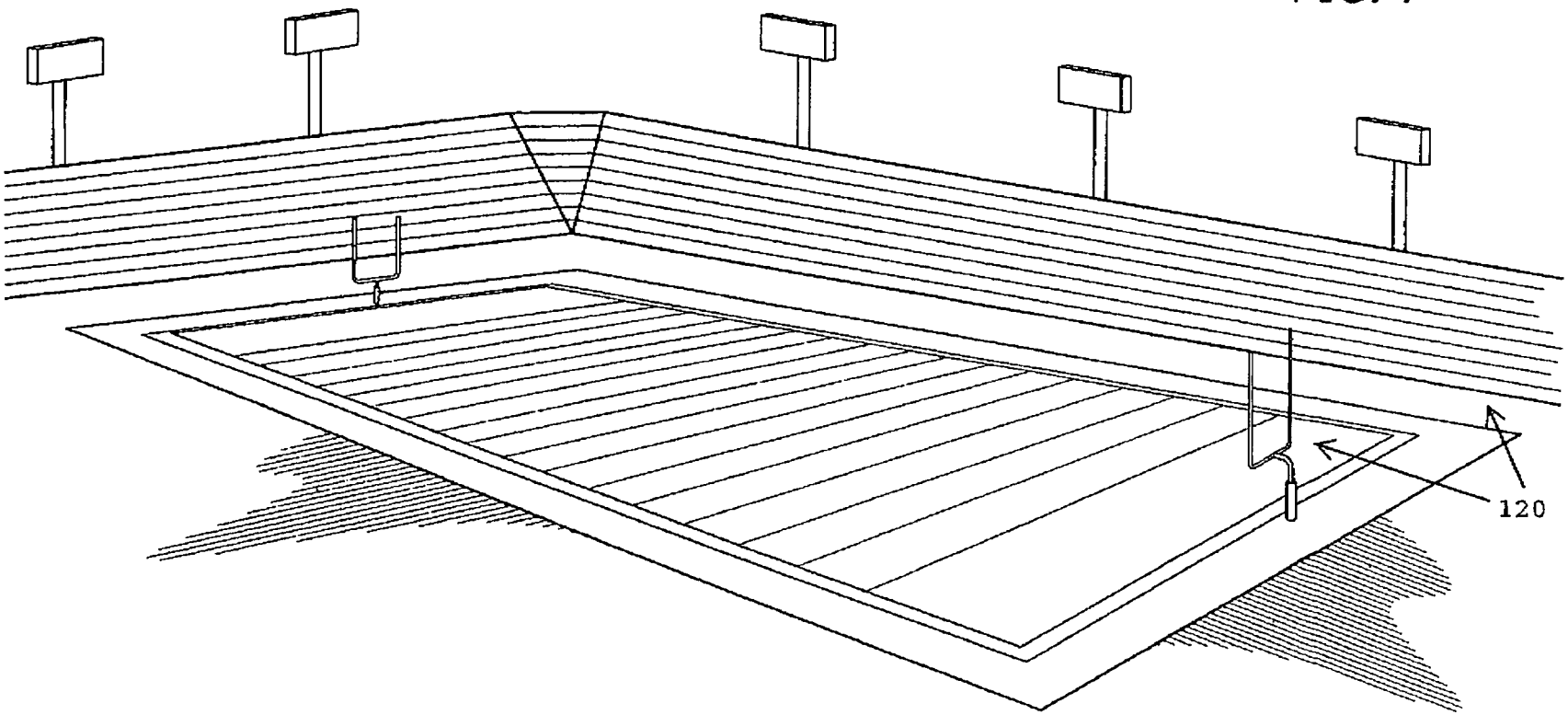
FIG. 7 illustrates a perspective diagram of the invention in an exemplary embodiment of the present invention.
Figure 8:
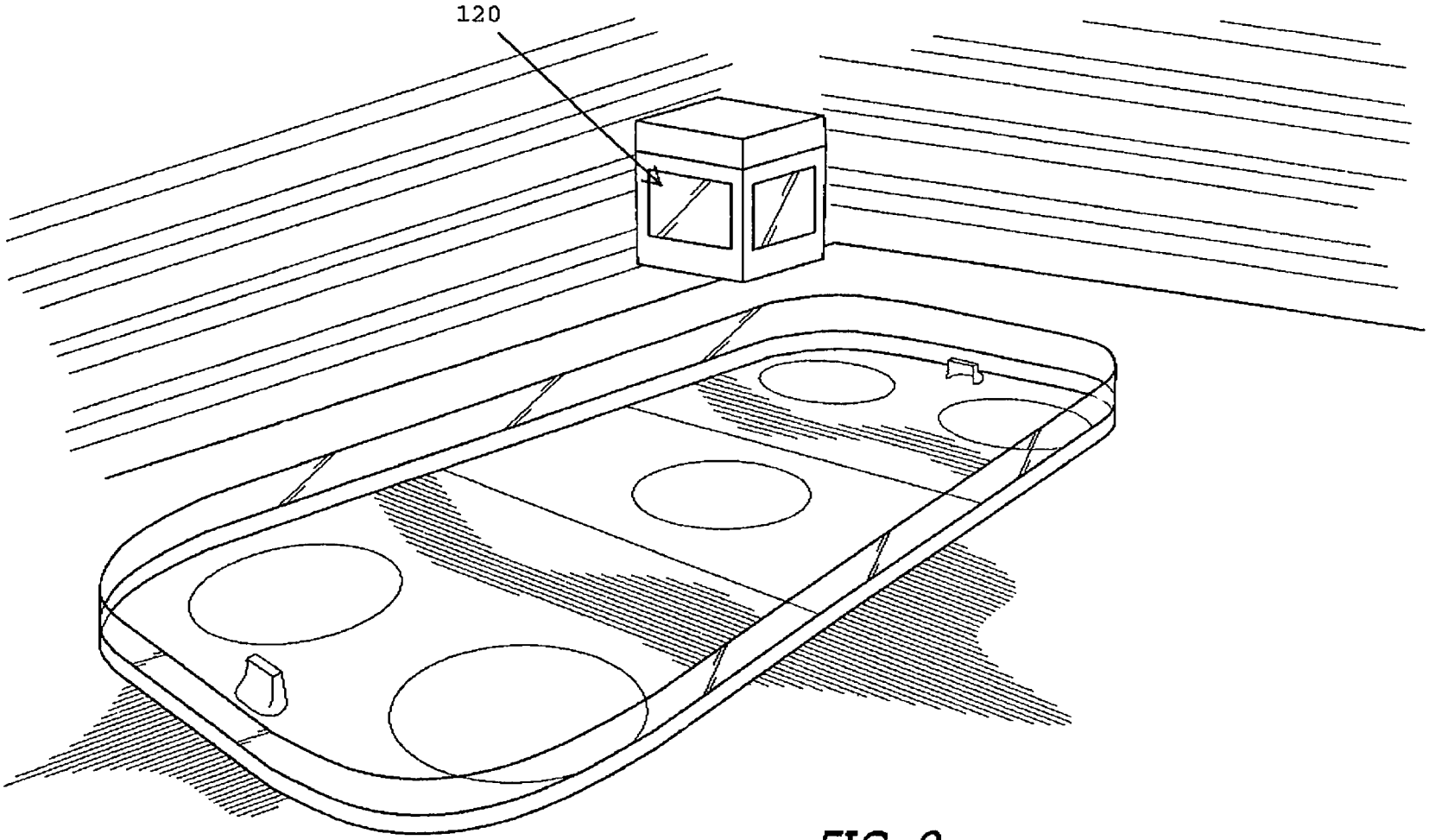
FIG. 8 illustrates a perspective diagram of the invention in an exemplary embodiment of the present invention.
Figure 9:
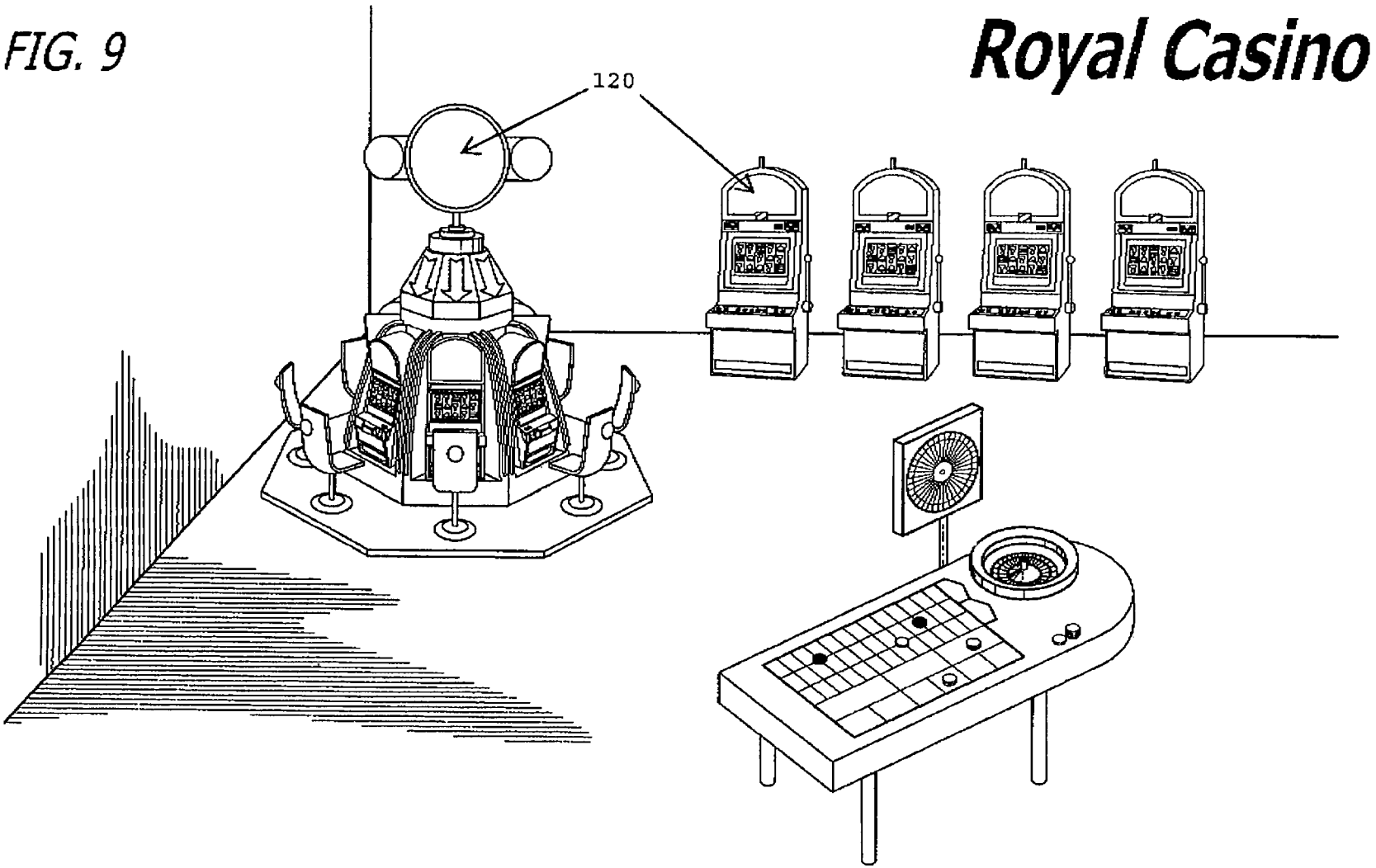
FIG. 9 illustrates a perspective diagram of the invention in an exemplary embodiment of the present invention.
Figure 10:
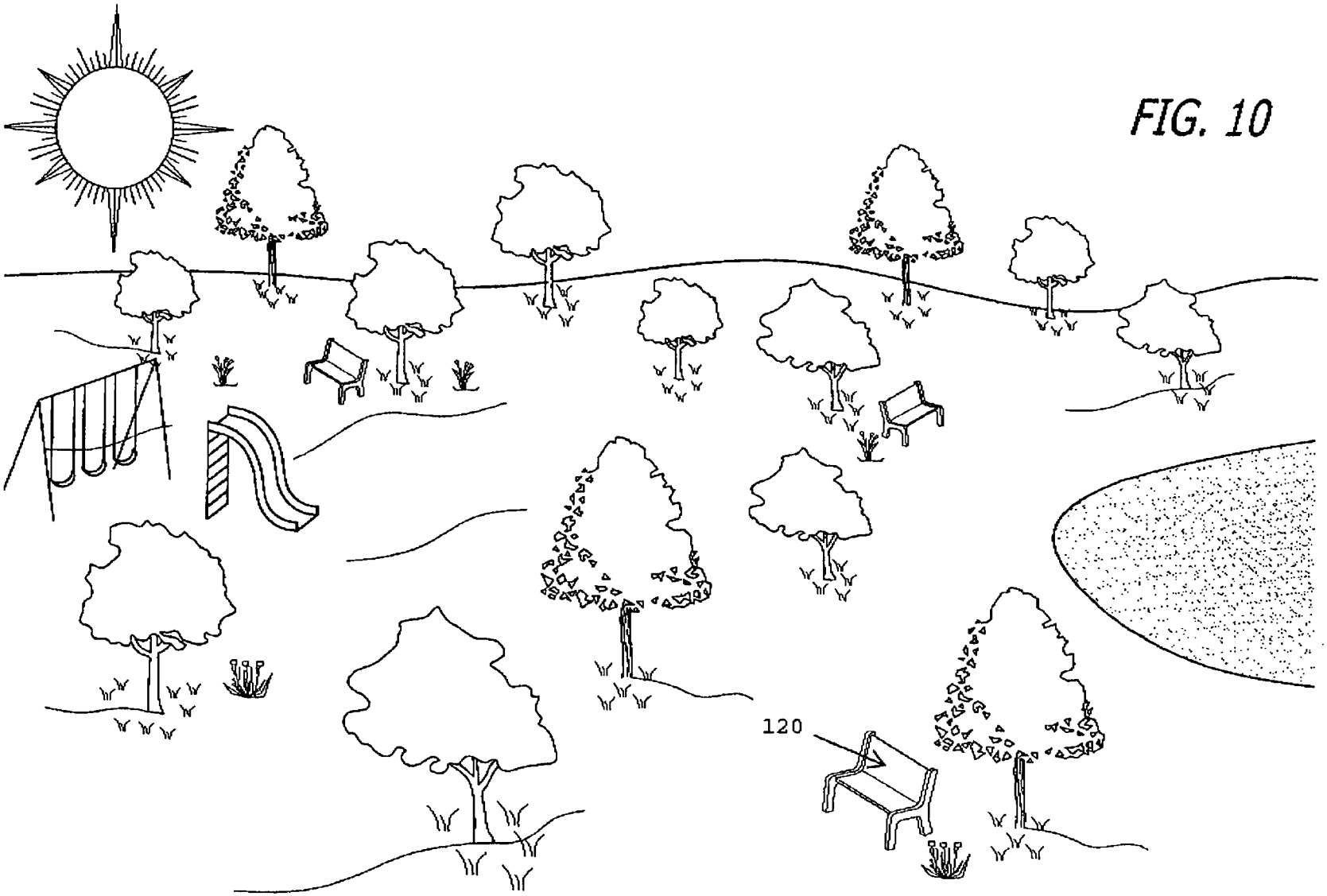
FIG. 10 illustrates a perspective diagram of the invention in an exemplary embodiment of the present invention.

The themed cemetery may take any of a plurality of shapes and sizes, depending on the desires and accommodations necessary for those wishing to be interned at the location. For example the themed cemetery may take the form of a baseball stadium (FIG. 5), a football stadium (FIG. 7), a hockey arena (FIG. 8), golf course (FIG. 6), a park (FIG. 10) and/or a casino (FIG. 9). Advertising and promotional space may also be provided within the themed cemetery to coincide with the advertising and promotional space provided at the corresponding facility for which the themed cemetery is modeled after. For example. the advertising and promotional space 120 may be on an outside wall of the modeled facility of the themed cemetery.

The above-described device may be altered by means known in the art without departing from the spirit and scope of this invention.

The inventive subject matter, therefore, is not to be restricted except in the spirit of the appended claims. The terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

While the invention has been described in what is presently considered to be an exemplary embodiment, many variations and modifications will become apparent to those skilled in the art. Accordingly, it is intended that the invention not be limited to the specific illustrative embodiment, but be interpreted within the full spirit and scope of the appended claims.

I claim:

1. A themed cemetery, the cemetery comprising a property simulating a racing facility:

a first portion of the property simulating a track area of the racing facility;

a second portion of the property closely simulating an inner field area of the racing facility;

a plurality of burial plots located throughout the property, said plurality of burial plots capable of interning caskets and cremated remains whereby said plurality of burial plots have different revenue value relative to each other at a given time depending on location within the property simulating the racing facility; and at least a portion of the property having advertising space thereon.

2. The cemetery described in claim 1 wherein advertising space is provided on an outside wall of the property.

3. The cemetery described in claim 1 wherein advertising and promotional space is provided within the property to coincide with advertising and promotional space provided at the racing facility.

4. The cemetery described in claim 1 wherein the advertising space is provided in the same locations where advertising is found in the racing facility.

5. The cemetery described in claim 1 further comprising: burial headstones having memorabilia related to the racing facility.

6. The cemetery described in claim 1 wherein the property further comprising a seating area, a pit area, and a winner's circle.

7. The cemetery described in claim 1 wherein the track area comprises a first area and a second area, the first area having generally uniform, ground level tombstones at a first revenue value and the second area comprising ornate tombstones at a second revenue value higher than the first revenue value.

8. The cemetery described in claim 7 wherein the generally ground level tombstones of the track are positioned to resemble a racing surface for the track area.

9. The cemetery described in claim 7 wherein the second area comprises headstones of specific memorials.

10. The cemetery described in claim 1 wherein the specific memorials include racing cars and drivers.

11. The cemetery described in claim 1 the inner field area has ornamental features consistent with a theme of the racing facility.

12. A method for creating a themed cemetery, the method comprising the steps of:

providing a property which simulates a racing facility both physically and visually but is not used as the racing facility, the property including a first portion closely simulating a track area of the racing facility and a second portion closely simulating an inner field area of the racing facility;

providing a plurality of burial plots located at different locations throughout the property whereby said plurality of burial plots have different revenue value relative to each other at a given time depending on location within the property;

said plurality of burial plots holding either caskets or cremated remains.

13. The method described in claim 12, wherein the track area comprises a first area and a second area, the first area having generally uniform, ground level tombstones at a first revenue value and the second area comprising ornate tombstones at a second revenue value higher than the first revenue value.

14. The method described in claim 12, the method further comprising the step of:

allowing someone to bury a deceased individual in a location that simulates social activities that the deceased member was involved in during their life, which is associated with the racing facility.

15. The method described in claim 12, the method further comprising the step of:

providing a seating area for visitors coming to the property whereby space is provided in the seating area for placement of deceased individuals' remains.

16. The method described in claim 15, wherein the seating area is configured to resemble a grand stand.

17. The method described in claim 12, the method further comprising the step of:

providing certain locations within the property whereby these certain locations provide increased revenue for burial at those locations.

18. The method described in claim 12, the method further comprising the step of:

providing monuments, articles and memorabilia which are incorporated into the property to simulate the racing facility for which the property is simulated after.

19. The method described in claim 12, the method further comprising the step of:

providing burial headstones and burial plots which have memorabilia that relate to a venue that the property is based on.

20. The method described in claim 12, the method further comprising the step of: providing advertising and promotional space within the property to coincide with advertising and promotional space provided at the racing facility that the property is simulated after.

* * * * *